US006311432B1

(12) United States Patent
Watson

(10) Patent No.: US 6,311,432 B1
(45) Date of Patent: Nov. 6, 2001

(54) SAFETY DEVICE FOR DOORS

(76) Inventor: Paul Lennard Watson, Eight Oak Avenue, Briarbank Park, Wilstead, Bedfordshire, MK45 3ES (GB)

( * ) Notice: Subject to any disclaimer, the term of this patent is extended or adjusted under 35 U.S.C. 154(b) by 235 days.

(21) Appl. No.: 08/813,965

(22) Filed: Mar. 3, 1997

(30) Foreign Application Priority Data

Mar. 2, 1996 (GB) ..... 9604530

(51) Int. Cl.[7] ..... E05D 11/00
(52) U.S. Cl. ..... 49/383
(58) Field of Search ..... 49/383; 16/250, 16/251, 402; 160/40, 41; 403/103, 106, 107

(56) References Cited

U.S. PATENT DOCUMENTS

| | | | | |
|---|---|---|---|---|
| 2,960,733 | * | 11/1960 | Nida | 49/383 |
| 2,995,785 | * | 8/1961 | Hallenbeck | 49/383 |
| 3,484,831 | * | 12/1969 | Higuchi | 403/103 |
| 3,934,371 | | 1/1976 | Ulatowski et al. | 49/383 |
| 3,941,180 | * | 3/1976 | Thill | 49/383 |
| 4,040,142 | * | 8/1977 | Ippolito | 49/383 |
| 4,344,253 | * | 8/1982 | Stiles | 49/383 |
| 5,383,739 | * | 1/1995 | Haglund | 403/106 |
| 5,544,456 | * | 8/1996 | Dries | 49/383 |
| 5,697,589 | * | 12/1997 | Garfinkle | 403/106 |

FOREIGN PATENT DOCUMENTS

| | | | |
|---|---|---|---|
| 778626 | | 7/1957 | (GB) . |
| 1 437 037 | | 5/1976 | (GB) . |
| 1437037 | * | 5/1976 | (GB) ..... 49/383 |

* cited by examiner

*Primary Examiner*—Daniel P. Stodola
*Assistant Examiner*—Curtis A. Cohen
(74) *Attorney, Agent, or Firm*—Young & Thompson

(57) ABSTRACT

A safety device for center pivot doors which prevents the crushing of fingers between the door and the door frame comprises a rigid elongate barrier member secured on one or both sides of the door which sweeps the zone between the door and the frame as the door pivots, and which is shaped substantially to fill the gap between door and frame when the door is fully opened. The barrier member is preferably adjustable by being made in two interengageable parts. The gap between door and frame can be further reduced by providing elongate shielding strips secured to the frame, one on each side of the door.

8 Claims, 4 Drawing Sheets

SAFETY DEVICE FOR DOORS

FIELD OF THE INVENTION

This invention relates to safety devices for doors, and is particularly concerned with safety guards for pivoted doors.

BACKGROUND OF THE INVENTION

Pivoted doors are conventionally hung with their vertical pivot axis some 50 mm to 75 mm from the adjacent door jamb. This means that when the door is opened, a gap opens up between the door jamb and the portion of the door on that side of the pivot axis. This gap is large enough for a hand or fingers to be trapped when the door closes again.

Various solutions have been proposed for finger protection for hinged doors. In one system, a finger excluder in the form of a profiled strip is connected on the hinge side of the door between the door itself and the frame. As the door opens, so the excluder hinges with it and the gap stays covered. When the door closes, the excluder regains its original shape. In another system, a roller blind is fitted between the door and the frame to give protection. In a further system, a concertina-like device is fitted to the frame and has its free end abutting the face of the door. It folds flat to the frame when the door is closed, and when the door is opened covers the opening between the door and the frame.

It is an object of the present invention to provide a safety device for pivoted doors, especially center pivot doors, which substantially reduces the risk of injury to fingers. The safety device of the present invention can be applied both to automatically operating pivoted doors and also to non-automatically operating pivoted doors.

It is a further object of the invention to provide a safety device for pivoted doors which can be fitted as a "retrofit" item to existing doors, as well as being provided as a fitting on newly manufactured doors.

It is an object of a preferred device according to the invention for it to be adjustable, allowing the device to be fitted on doors with a wide range of pivot placements and yet allowing each installation to be precisely configured so as to remove the potential finger trap.

SUMMARY OF THE INVENTION

In accordance with the present invention there is provided a safety device for use with a pivoted door, the device comprising a rigid elongate barrier member adapted to be fitted to a side of the door stile adjacent to the jamb and parallel to the vertical door edge, and serving to sweep the zone between the jamb and the adjacent stile as the door is pivoted, the barrier member being shaped substantially to fill the gap between door jamb and door stile when the door is in its fully opened position.

The barrier member attached to the door stile thus blocks the entrance to the gap between door jamb and door stile and thus prevents a hand or fingers being pushed into that zone.

The barrier member is preferably of generally triangular shape in horizontal cross-section. One limb of the triangle preferably is shaped as an extension of the vertical end face of the door stile.

An important preferred feature of the invention is that the barrier member can be adjustable in shape, in order that it can be readily adapted for use with doors of different configurations and different positions for the vertical pivot axis. This adjustment can conveniently be effected by providing the barrier member with a ratchet-type means of adjustment. This provides the barrier member with a plurality of alternative settings, with the most appropriate one being chosen upon the fitting of the barrier member to the door.

In a preferred embodiment of the invention the safety device also includes rigid shielding strips adapted to be positioned vertically down the door jamb, further to reduce the possibility of access to the zone between the door jamb and the door itself. These shielding strips function in cooperation with the barrier member as it sweeps through the zone between the door jamb and the door.

The safety device of the present invention provides a number of benefits. These include not only the prevention of finger crushing, but also zero maintenance, and the ability to fit the device to existing doors without modification or removal of the door. It can be fitted to fire doors without affecting their integrity, because it does not interfere with the door seals. One simple system will fit almost every centrally pivoted door, either aluminum or timber. Also, it does not hinder the reglazing of damaged doors.

BRIEF DESCRIPTION OF THE DRAWINGS

In order that the invention may be more fully understood, two presently preferred embodiments of safety device in accordance with the invention will now be described by way of example and with reference to the accompanying drawings, in which.

DETAILED DESCRIPTION OF THE PREFERRED EMBODIMENTS

Figure 1:
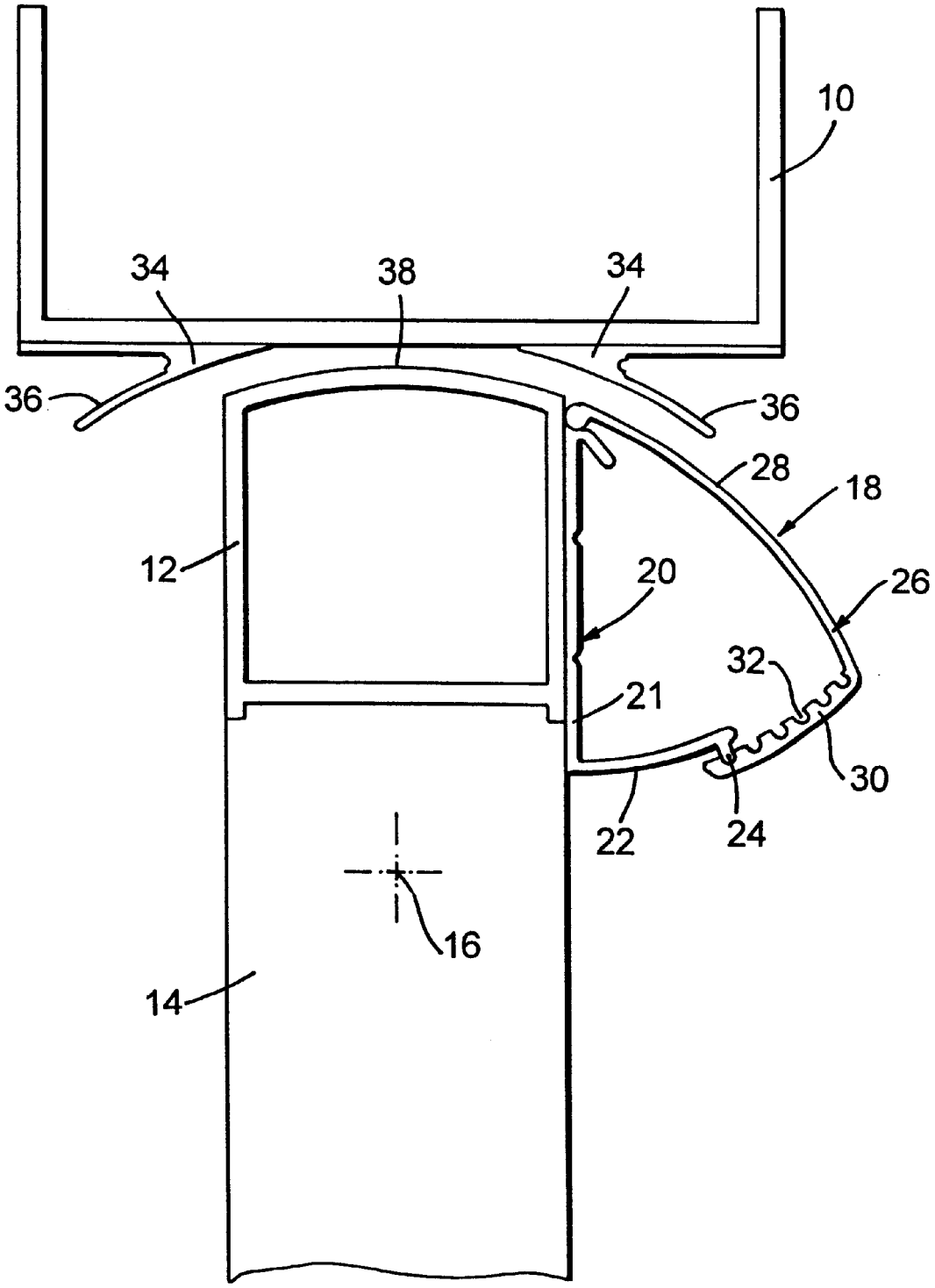
FIG. 1 is a schematic illustration of a first embodiment of safety device, shown with the door in its closed position, and with the barrier member in one extreme setting.
Figure 2:
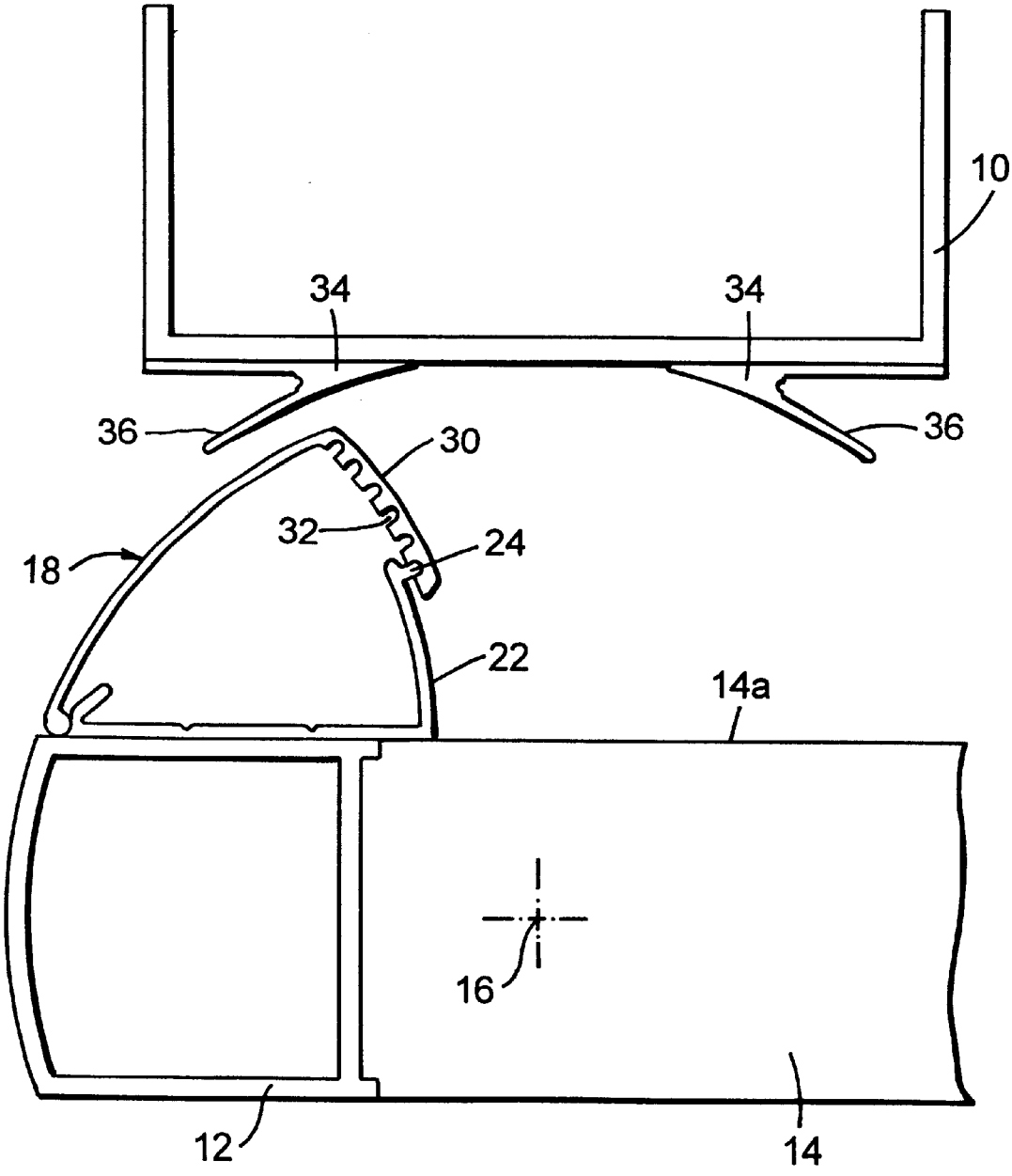
FIG. 2 is a view of the safety device of FIG. 1, but with the door in its fully opened position.

Referring first to FIG. 1, this shows a door jamb 10 which can be an aluminum extrusion for example. Positioned adjacent to the door jamb is the stile 12 of a door 14 which is hung for pivotal movement about a vertical central pivot axis 16. The present invention is applicable particularly to center-pivot doors. The door 14 is pivotable between the closed position shown in FIG. 1 and the open position as shown in FIG. 2. It will be appreciated from FIG. 2 that when the door is in the opened position there is a substantial gap between the door jamb 10 and the adjacent face 14*a* of the door 14. It is this gap which gives rise to concern in terms of possible injury.

In accordance with the invention there is provided a rigid elongate barrier member, indicated generally at 18, on the side of the door stile 12 which faces the direction towards which the door is to open. In the event of a door which is a double-action door, i.e. openable in both directions, one can fit a barrier member on both sides of the stile 12. The barrier member 18 is in two parts, formed for example as aluminum extrusions extending the height of the door. The one part 20 is of scythe shape having its longer limb 21 arranged to be secured to the door stile 12, for example by screws (not shown). The shorter arm 22 is provided at its free end with a vertically extending projecting rib 24. The other part 26 of the barrier member 18 is also of scythe shape. Here however the longer arm 28 is arcuate and the shorter arm 30 is provided on its internal face with a plurality of vertically extending grooves 32 for engagement by the rib 24. Viewed overall, the barrier member 18 is of generally triangular configuration in horizontal section.

To further minimise the possibility of fingers becoming trapped in the gap between the door jamb and the door, the door jamb 10 is fitted with a pair of vertically extending shielding strips 34. These shielding strips 34 can also be aluminum extrusions, with flange portions 36 which are curved to follow the general line of the end face 38 of the stile 12 and the outer surface of the arcuate arm 28 of the barrier member 18. As can be seen most clearly in FIG. 2, with the door in its fully opened position, the flange portion 36 of the shielding strip 34 effectively masks the small gap remaining between the barrier member 18 and the door jamb 10, ensuring that fingers cannot be pushed into the gap.

Figure 3:
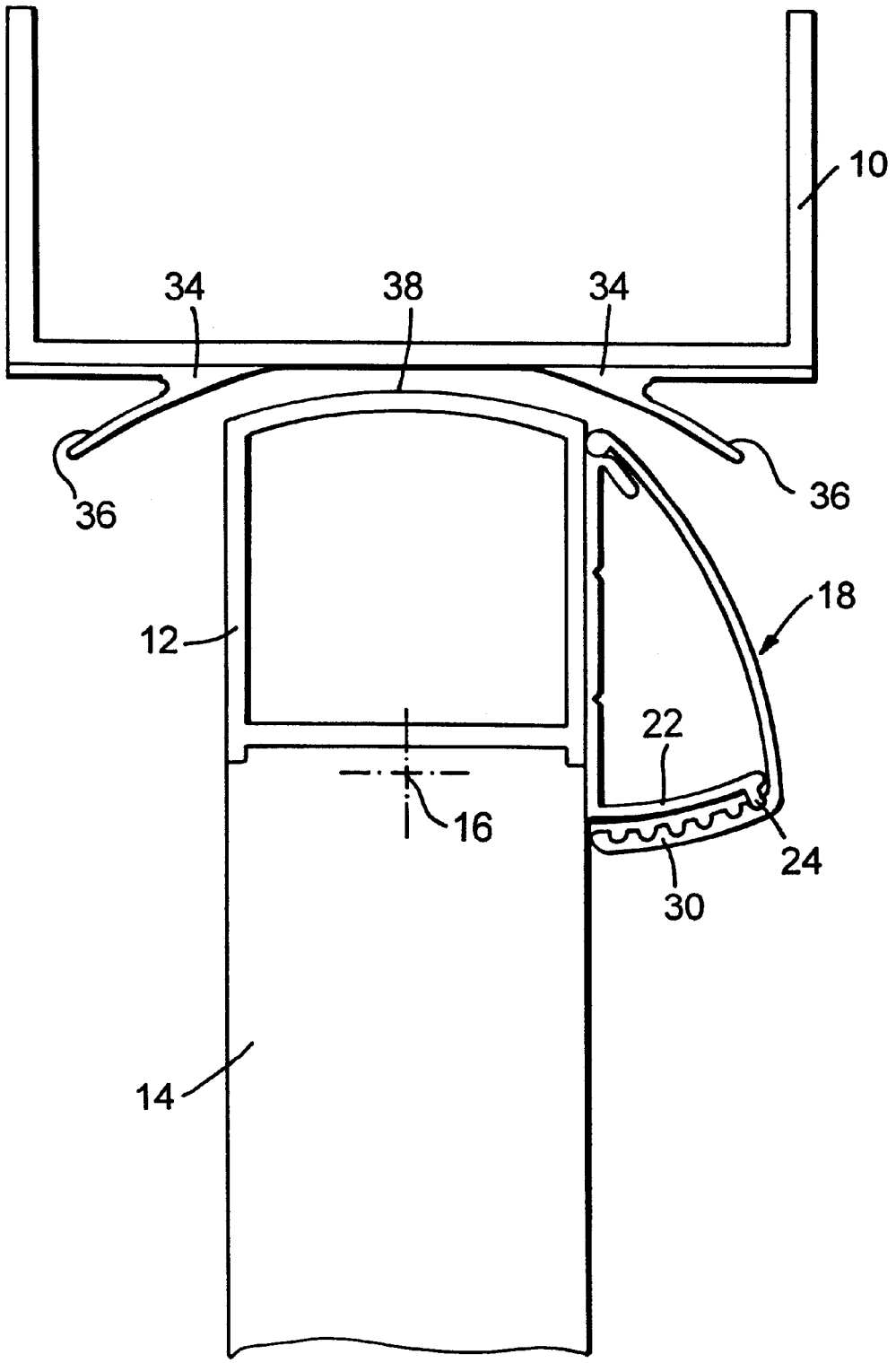
FIG. 3 is a schematic illustration of a slightly different door assembly, with the door in its closed position, and with the barrier member in its other extreme setting; and, FIG. 4 is a view of the arrangement shown in FIG. 3, but with the door in its fully opened position.
Figure 4:
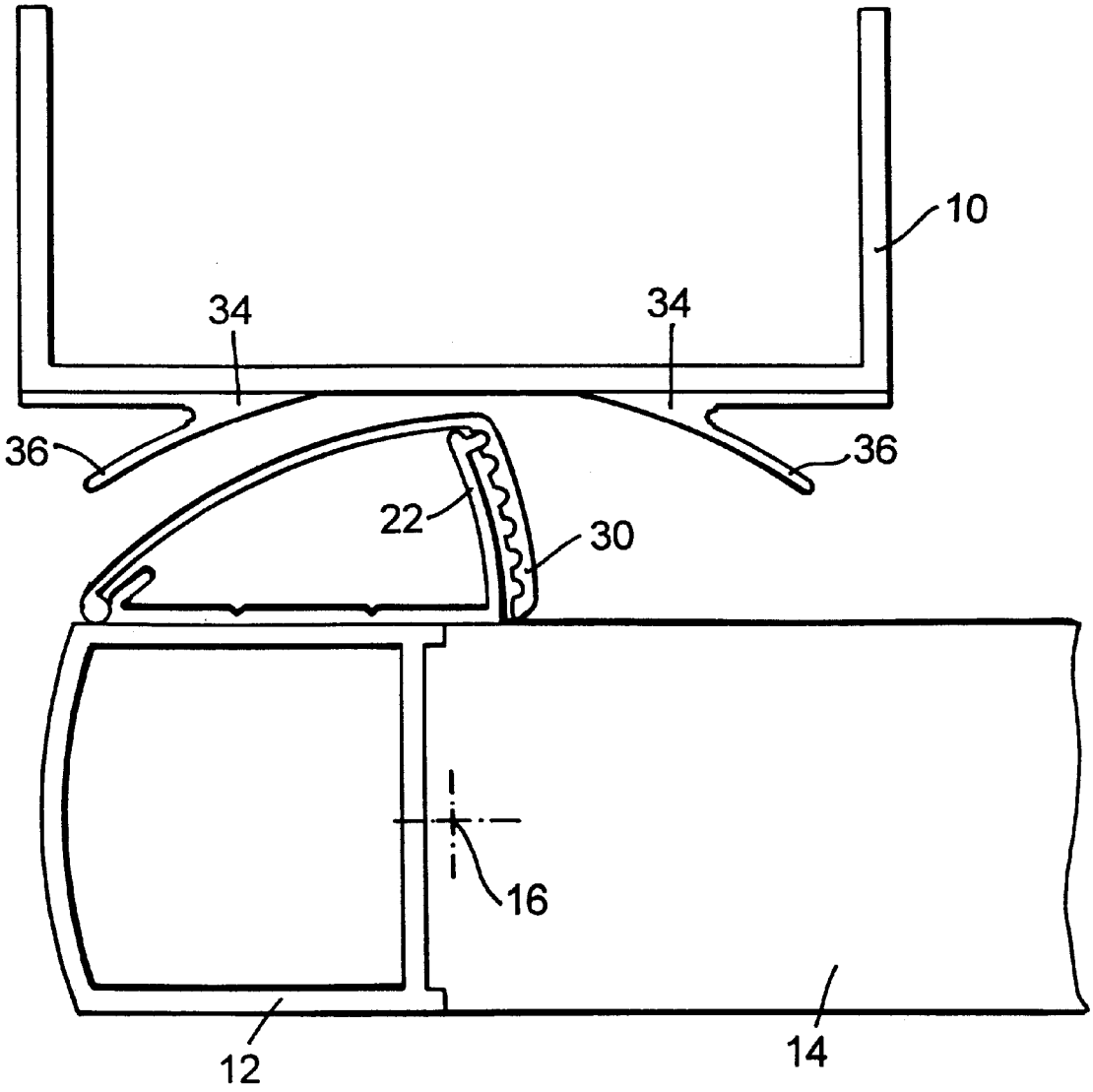

The barrier member 18 and the shielding strips 34 are suitable for retrofitting to existing doors. In use, the shielding strips 34 are fastened to the door jamb 10. Their positioning is determined by the pivot center of the door, ensuring the closest path of movement between the strips and the barrier member, whilst avoiding contact. The flat limb 20 of the barrier member is fastened to the door stile 12. The one end of the other part 26 of the barrier member is hooked onto the limb 20 and the choice of the rib and groove setting is determined by the configuration and dimensions of the door assembly. The setting is chosen which most effectively blocks the gap between jamb and stile without fouling the door jamb or the shielding strips 34. For a door assembly as shown in FIGS. 1 and 2, where the vertical pivot axis 16 is a relatively long way distant from the door jamb 10, the barrier member 18 is set to its position of maximum volume by locating the rib 24 in the outer end groove 32. In contrast, with the door assembly as shown in FIGS. 3 and 4, where the vertical pivot axis 16 is closer to the door jamb, and where the door stile 12 is closer to the door jamb as well, the barrier member 18 is shown with its minimum volume, i.e. with the rib 24 located in the groove 32 which is closest to the corner of the other part 26. With this minimum volume setting the barrier member 18 can still sweep through the gap between door jamb and stile without fouling the shielding strips 34, as shown in FIG. 4.

Although the shielding strips 34 with their flanges 36 are useful in a door assembly as shown in FIGS. 1 to 4, they are particularly valuable in the case of a door stile 12 which has a flat end face 38 instead of the curved end face which is shown in the drawings.

It should be noted that the safety device of the present invention is applicable both to automatically functioning pivoted doors and also to non-automatically functioning pivoted doors.

The safety device of the present invention can be used regardless of the distance between the vertical pivot axis 16 of the door and the adjacent door jamb 10. The distance normally varies between 50 mm and 75 mm, but the fact that the barrier member 18 is capable of adjustment means that it is in effect a "universal" fitting which can be utilised with substantially any pivoted door assembly.

The safety device of the present invention is also applicable to pivoted doors of glass where there is no hanging stile as such and where the door jamb is not an extrusion as shown in the drawings but is a piece of plate glass which functions as an extension of the door itself. In the case of such a pivoted door arrangement, a barrier member similar to the barrier member 18 can be fitted to one or both sides of the door in a position similar to that shown in the drawings. In the case of a transparent glass door the barrier member would preferably be made of a clear plastics material and could be secured to the door by adhesive for example. Again, the safety barrier could be made adjustable in size to enable it to be adapted to different pivot mountings.

The present invention may be embodied in other specific forms without departing from the spirit or essential attributes thereof, and, accordingly, reference,should be made to the appended claims, rather than to the foregoing specification, as indicating the scope of the invention.

What is claimed is:

1. A pivoted door assembly comprising:

a door frame including a door jamb;

a pivotally mounted door having a stile with opposite parallel sides adjacent to the door jamb with a gap between the stile and the door jamb; and a safety device fitted to at least one side of the stile, the safety device comprising a rigid elongate finger guard adapted to be fitted to a side of the stile adjacent to the door jamb and parallel to a vertical door edge, and serving to sweep the gap between the door jamb and the adjacent stile as the door is pivoted, the finger guard being shaped substantially to fill the gap between the door jamb and the stile when the door is in its fully opened position, and the finger guard incorporating adjustment means for enabling the cross-sectional shape of the guard to be varied by choice of alternative settings of the adjustment means.

2. A pivoted door assembly as claimed in claim 1, wherein the finger guard is of generally triangular shape in horizontal cross-section.

3. A pivoted door assembly as claimed in claim 1, wherein the door has a vertical end face and the finger guard comprises at least two parts, one of which is secured to the door and another of which is shaped as an extension of the vertical end face of the door.

4. A pivoted door assembly as claimed in claim 3, wherein the finger guard comprises two scythe-shaped parts each having a longer limb and a shorter limb, one part having its longer limb secured to the door, and the other part having an arcuate longer limb, with the respective shorter limbs in engagement with one another.

5. A pivoted door assembly as claimed in claim 4, wherein the adjustment means comprise a ratchet-type mechanism providing alternative settings for two interengageable parts of the finger guard, thereby to change the cross-sectional shape of the finger guard, and wherein one of the shorter limbs has a plurality of parallel grooves along the length thereof, and the other shorter limb has a projecting rib selectively engageable in one of said grooves.

6. A pivoted door assembly as claimed in claim 1, wherein the adjustment means comprise a ratchet-type mechanism providing alternative settings for two interengageable parts of the finger guard, thereby to change the cross-sectional shape of the finger guard.

7. A pivoted door assembly as claimed in claim 1, including a pair of rigid elongate shielding strips secured to the door jamb, one on each side of the door in its closed position to reduce the size of the gap between the door and the door jamb.

8. A pivoted door assembly as claimed in claim 7, wherein the shielding strips are extrusions which present a curved surface towards the door and towards the finger guard which moves past the shielding strips in spaced relationship thereto.

* * * * *